US008203274B2

(12) United States Patent
De Castro

(10) Patent No.: US 8,203,274 B2
(45) Date of Patent: Jun. 19, 2012

(54) LED AND THERMAL MANAGEMENT MODULE FOR A VEHICLE HEADLAMP

(76) Inventor: Erwin L. De Castro, San Jose, CA (US)

( * ) Notice: Subject to any disclaimer, the term of this patent is extended or adjusted under 35 U.S.C. 154(b) by 174 days.

(21) Appl. No.: 12/806,470

(22) Filed: Aug. 13, 2010

(65) Prior Publication Data

US 2012/0038272 A1 Feb. 16, 2012

(51) Int. Cl.
*H01J 7/24* (2006.01)

(52) U.S. Cl. ..... 315/112; 362/294; 362/545; 362/547

(58) Field of Classification Search ..... 315/32–33, 315/112, 82, 84, 77, 76, 58, 185 R, 51; 362/218, 362/264, 294, 345, 373, 547, 296.01, 311.02, 362/545, 580, 800
See application file for complete search history.

(56) References Cited

U.S. PATENT DOCUMENTS

| | | | | |
|---|---|---|---|---|
| 5,980,066 | A * | 11/1999 | Belliveau et al. | 362/281 |
| 6,374,780 | B1 | 4/2002 | Rutyna et al. | |
| 7,114,837 | B2 * | 10/2006 | Yagi et al. | 362/523 |
| 7,178,941 | B2 | 2/2007 | Roberge et al. | |
| 7,387,403 | B2 | 6/2008 | Mighetto | |
| 7,510,303 | B2 | 3/2009 | Jonsson et al. | |
| 7,520,628 | B1 | 4/2009 | Sloan et al. | |
| 7,621,664 | B2 * | 11/2009 | Nicolai | 362/547 |
| 7,621,667 | B2 * | 11/2009 | Behr et al. | 362/651 |
| 7,646,029 | B2 | 1/2010 | Mueller et al. | |
| 7,646,151 | B2 | 1/2010 | Böröczki et al. | |
| 7,841,756 | B2 * | 11/2010 | Kracker et al. | 362/505 |
| 2006/0104077 | A1 * | 5/2006 | Oshio et al. | 362/547 |
| 2007/0273290 | A1 | 11/2007 | Ashdown et al. | |
| 2008/0007953 | A1 | 1/2008 | Keller et al. | |
| 2008/0295522 | A1 | 12/2008 | Hubbell | |
| 2009/0185381 | A1 | 7/2009 | Willwohl et al. | |
| 2009/0195159 | A1 | 8/2009 | Smith et al. | |
| 2009/0296417 | A1 | 12/2009 | Luo et al. | |
| 2010/0091495 | A1 | 4/2010 | Patrick et al. | |
| 2010/0096993 | A1 | 4/2010 | Ashdown et al. | |

* cited by examiner

*Primary Examiner* — Shawki S Ismail
*Assistant Examiner* — Christopher Lo
(74) *Attorney, Agent, or Firm* — Walt Froloff

(57) ABSTRACT

The LED headlamps for vehicles provide a modular efficient light source for vehicle headlamps. The invention addresses the LED negative temperature coefficient in efficient heat removal system. Beam direction and pattern is controlled by its composite lens beam shaping mechanism. The beam targeting using the LED source is done through beam shaping via lens surface shaping, lens curvature contouring and composite lens component offsetting from the LED source or outgoing beam axis to direct the light beam.

15 Claims, 11 Drawing Sheets

Temperature Metrics

LED Module Isometric

Two Aspheric Lens Configuration

LED AND THERMAL MANAGEMENT MODULE FOR A VEHICLE HEADLAMP

BACKGROUND

Field of the Invention

The present invention generally relates to headlamp assembly in vehicles and more specifically, to LED light source headlamps requiring modular designs for aggressive heat removal to counter the negative temperature coefficient of the LED and addressing fundamental beam shaping in compliance with code.

Although LED light sources are very efficient, they have negative temperature coefficient aspects, i.e. at fixed power input, as the device's operating heat rises, the device's light output decreases. That is, as the LED device's operating temperature increases one .degree. C. it can by approximated that the device will lose about one percent of its light output.

Hence there exist designs for lamp assembles using LED sources with different solutions for the heat removal from the LEDs during operation. At least one LED illuminated lamp with thermoelectric heat management have been offered. This is comprised of a device with one or more thermoelectric modules (TEM) having a cold surface and a hot surface, such that the cold surface is thermally connected to the LED and the hot surface is thermally connected to a heat sink. By applying a TEM-operating current (TOC) to the one or more TEMs to create a temperature gradient through the TEM, adjusting the TOC such that substantially all of the thermal energy created by the LED(s) is transferred to the heat sink, thereby substantially maintaining the operating temperature of the LED(s) at ambient temperature or a lower temperature.

The LED base structures are thermally coupled to a second surface of at least one TEM. A thermally insulating cover creates a chamber substantially insulating the LED from ambient air. These designs primarily use the Peltier effect. The Peltier effect relies mainly on heat conduction, where convection based heat transfer may offer better thermal characteristics and higher efficiencies.

Since convective heat transfer is so much more efficient in heat removal, more efficient forced convection based methods of heat removal would provide higher electrical efficiencies can be along with better LED luminescence characteristic.

Another approach embodies a feedback mechanism in conjunction with other modules to produce white light, or light of any other color within the color spectrum. Each module comprises one or more light-emitting elements, a drive and control system, a feedback system, thermal management system, optical system, and optionally a communication system enabling communication between modules and/or other control systems. Depending on the configuration, the lighting module can operate autonomously or its functionality can be determined based on either or both internal signals and externally received signals.

The thermal management system comprises physical contact with the light-emitting elements and provides a predefined thermal path for the heat to be transferred away from the light-emitting elements. Heat pipes and other path are used in the thermal management. While these are more efficient in heat removal than conduction, heat pipes are expensive and may still not be the fastest more efficient heat removal method.

Here with electrical feedback the optical system can be designed to provide characteristics of optimal collection efficiency of the illumination emitted by the light source, beam collimation with low residual divergence or a closely-matched Lambertian beam profile and more. These very sophisticated methods require more sophistication in the controls and programming. This escalates costs even higher. What is needed are less expensive but just as effective and efficient ways to leverage the LED in vehicle headlamps. These systems do not take full advantage of geometry, relying instead on brut force and higher control systems to resolve a simpler problem, maximum luminescence at minimum of cost, all costs.

Although improving vehicle visibility, vehicle headlamp assembly costs, material costs, installation costs, maintenance costs, space occupation costs, and more have risen with the use of the LED and higher technology to manage this relatively new light source. What is needed are systems that take full advantage if the LED light in vehicle headlamps while reducing assembly costs, material costs, installation costs, maintenance costs, space occupation costs, beam shaping and yet increasing the LED luminescence/watt efficiency.

Another approach discloses lighting systems comprising: substantially linear housing having a first cavity extending longitudinally, the first cavity holding a circuit board, the circuit board supporting a plurality of LED light sources. These provide power to the light sources, providing a channel extending longitudinally within the housing and spaced apart from the first cavity between the circuit board and the power facility for shielding the light sources from heat produced by the power facility. The power facility is in a second cavity extending longitudinally within the housing and spaced part from the channel.

The power facility is exterior to the housing in this design. The power facility is a modular power supply that can be positioned movably on the outside of the housing, comprising a plurality of fins for dissipating heat from the power housing, or in other embodiments comprising a fan for circulating air within the housing to dissipate heat from the light sources and the power facility. A thermal sensor provides temperature conditions responsive to the fan operation.

This system depends on natural convection in its heat removal path, and the external power source location are not optimal for assembly, material, maintenance or space costs. What is needed are more compact lamp assemblies, faster more direct heat removal and reduced space usage costs.

Yet another invention discloses a rear-loading LED module for a rear combination lamp. One or more LEDs are mounted on a printed circuit board that electrically powers and mechanically holds them outside a faceted, parabolic reflector. Light emitted from the LEDs enters a light propagation region, formed between the reflective adjacent faces of two nested cylinders. The cylinders extend from the LEDs, outside the reflector, longitudinally through a hole at the vertex of the reflector, to the focus of the reflector. In some applications, the light propagation region may act as a beam homogenizer, so that light exiting the light propagation region may have roughly uniform intensity. Light from the light propagation region strikes an outwardly-flared reflector that directs it largely transversely onto the parabolic reflector. The parabolic reflector collimates the light and directs it longitudinally, through a transparent cover and out of the lamp. The parabolic reflector may have facets that angularly divert portions of the reflected light to form a desired two-dimensional angular distribution for the exiting beam.

This design applies one heat removal path for the two or more heat sources, and LED-based lighting module and the driver circuitry that powers the LED chip. What is needed are more efficient methods of heat removal and without sacrificing luminescence from LEDs. Also this design requires much volume and is a fixed geometry, axial.

Headlamp beam patterns for vehicles must comply with minimum light emission region requirements. These are characteristic of a front lob for far ahead vision and side lobes for near the road side view. Some current vehicle manufacturers headlight packages several light sources with separate lamp modules into a common headlamp assemble. They use five white LED lights to illuminate the road. The light distribution pattern is adjusted to avoid shining bright light into the eyes of oncoming drivers. Two of the lamps add a projector technology to illuminate the area around and directly in front of the vehicle. This projector technology consists of curved reflecting surfaces that adds cost of materials, assembly, installation and adjustment. Three of the white LED lights modules are used to illuminate forward distance. Each white LED light holds four large 1 mm blue LED chips inside a their own separate module. These are aimed independently to achieve the light distribution pattern required. Conventional designs use a shade to create the desired pattern by blocking light.

What is needed are less expensive ways to achieve the desired light distribution. Five white LED modules adds cost and complications and additional heat. As vehicle headlight assemblies grow in cost, they also grow in size and volume of vehicle consumed. What is needed are more powerful lights with smaller foot prints.

SUMMARY

The present invention discloses a very compact cost saving LED light module for a headlight assembly. The module comprises an LED array light source on backing thermally coupled to a cooling fin element; the first cooling fin element base thermally coupled to the LED with the opposite side having an array of protruding cooling fin legs with distal ends adjacent to a fan, protruding cooling fin leg array supported by the substantially thin flat base element; a thin flattened fan in a plane parallel to the first cooling fin base element, sandwiched between the first cooling fin element and a second cooling fin element, fan electrically coupled to a power source. The second cooling fin element is juxtaposed and parallel to the first cooling fin element, comprising a flat base supporting an array of protruding cooling fin short legs with distal ends adjacent to the fan and base ends coupled to the thin base element in a plane parallel to the plane of the fan, the base element side opposite the leg array thermally coupled to an LED driver circuit board.

An LED driver circuit board with electronic circuitry for supplying the LED light source with voltage and current of a predetermined waveform and magnitude powers the LED source in accordance with electrical requirements of the LED and electronics. An optical composite lens is used to shape and direct the source beam. One embodiment optical composite lens comprises a partially aspheric lens with a cross-sectional flat side is uniformly coupled to a flat bi-concave lens element. The flat bi-concave lens element is coupled to a reflective surface on the side opposite the aspheric element side, for redirecting and collimating light emanating from the LED light source input surface and towards the lens output surface.

The LED light module contains a compactly structured LED light source with beam shaping composite lens for collimating and directing light onto a desired forward pattern, associated thermal management and control circuitry for minimizing the LED negative temperature coefficient character, all in one package installable in a vehicle headlight with minimum space requirements and in compliance with multi-lobe pattern road illumination requirements.

BRIEF DESCRIPTION OF DRAWINGS

Specific embodiments of the invention will be described in detail with reference to the following figures.

DETAILED DESCRIPTION

Figure 1:
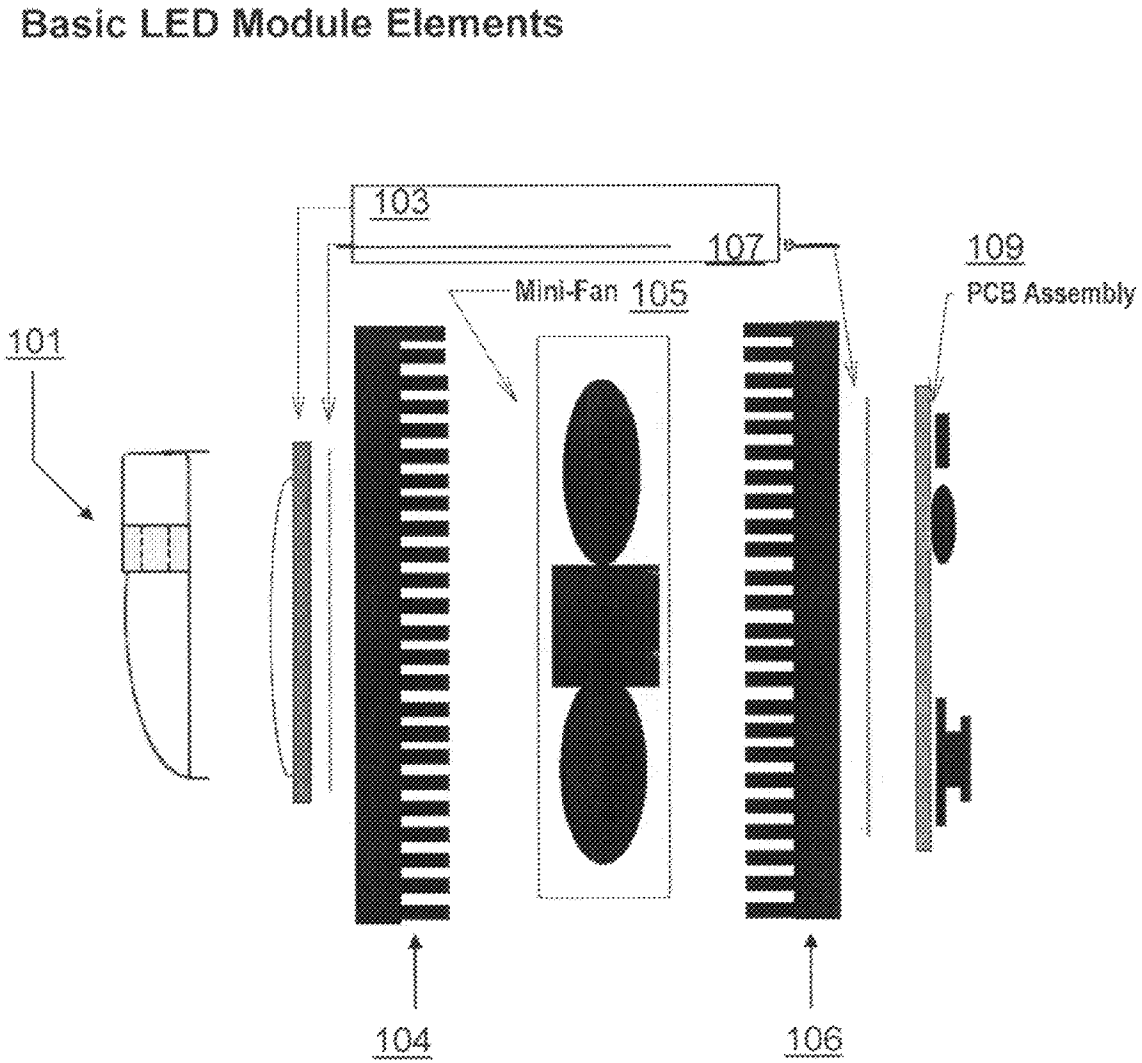
FIG. 1 is a schematic diagram illustrating the basic LED module elements according to an embodiment of the present invention.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

OBJECTS AND ADVANTAGES

The present invention discloses a vehicle LED headlight module. The objects and the advantages are described in more detail but the highlights are listed directly below.

Accordingly, it is an object of the present invention to use aspheric lens surface profiles for beam shaping the light to achieve various desired vehicle headlight patterns.

It is another object of the present invention to provide embodiments designed to use aspheric lens surfaces to reduce or eliminate spherical aberration and also reduce other optical aberrations that waste otherwise useable illumination lumens.

It is another object of the present invention to provide embodiments which reduce the number of LED lights necessary to achieve the illumination profile required to a single LED light module.

It is another object of the present invention to provide embodiments to reduce the general size requirements of a vehicle headlight assembly for LED lights to ⅕th (by 5000%)

It is another object of the present invention to provide embodiments which substantially reduce maintenance for headlights and provide LED module life expectancy of about 40,000 hours of continuous use.

It is another object of the present invention to provide embodiments in which the LED array and electronic driver compartment is water sealed. This object can extend to the cooling fan if it is a NCB (Nanometer Ceramic Bearing) fan.

It is another object of the present invention to provide embodiments which reduce cost of material and manufacturing by approximately 40% lower than similar type of modular LED.

It is another object of the present invention to provide embodiments which reduce power consumption to 28 watts per LED module.

It is another object of the present invention to provide embodiments which reduce the LED module form factor which creates available under the vehicle hood space It is another object of the present invention to provide material cost savings in the entire headlight assembly.

It is another object of the present invention to provide a simple design with cost savings for manufacturing It is another object of the present invention to provide life extension and which will inure headlight replacement cost savings.

It is another object of the present invention to provide better than an average lumen output by the LED module of approximately 2100 lumens.

It is another object of the present invention to design a LED module whereby the assembly and installation is plug and play, with no separate ballast from the LED module and all component parts contained inside the module.

It is another object of the present invention to provide an anti-shock and anti-vibration LED module.

It is another object of the present invention to provide an LED module with adjustable beam shot for US and European requirement compliance.

It is another object of the present invention to provide embodiments with LED module which do not require a cut-off shield and which therefore increase lighting efficiency, modules with a lens fitted with an aspheric bi-concave lens for regular low beam lighting to meet light pattern distribution on the road set by USDOT.

EMBODIMENTS OF THE INVENTION

FIG. 1 is a schematic diagram illustrating the basic LED module elements according to an embodiment of the present invention.

An LED light module is shown with an LED array 103 light source on backing thermally coupled with thermal compound 107 to a first cooling fin element 104. An optical composite lens 101 is structurally affixed to receive, collimate and direct the LED Array 103 light. The composite lens 101 is shaped or configured to conform with optical properties for shaping the outgoing beam. This composite lens 101 has one or more lens components with distances and offsets from the source and beam centerline to direct the source beam at angles calculated for distance and pattern desired.

The first cooling fin element 104 base thermally coupled to the LED array 102 with the opposite side having an array of perpendicularly protruding cooling fin short legs with distal ends adjacent to a fan 105. The protruding cooling fin 104 leg array is supported by the substantially thin flat base element which is in a plane parallel to the plane of the fan 105. The thin fan in a plane is sandwiched between the first cooling fin element 104 and a second cooling fin element 106, wherein the fan is electrically coupled to a power source. The second cooling fin element 106 is juxtaposed and parallel to the first cooling fin element 104 and also has a flat base supporting an array of protruding cooling fin short legs with distal ends adjacent to the fan 105 and base ends coupled to the thin base element. The base element side opposite the leg array is thermally and structurally coupled to an LED driver circuit board 109 by thermal compound 107 or thermal adhesive. The LED driver circuit board 109 contains electronic circuitry for supplying the LED light source with voltage and current of a predetermined waveform and magnitude to power the LED source in accordance with electrical requirements of the LED array 103 and electronics.

Figure 2:
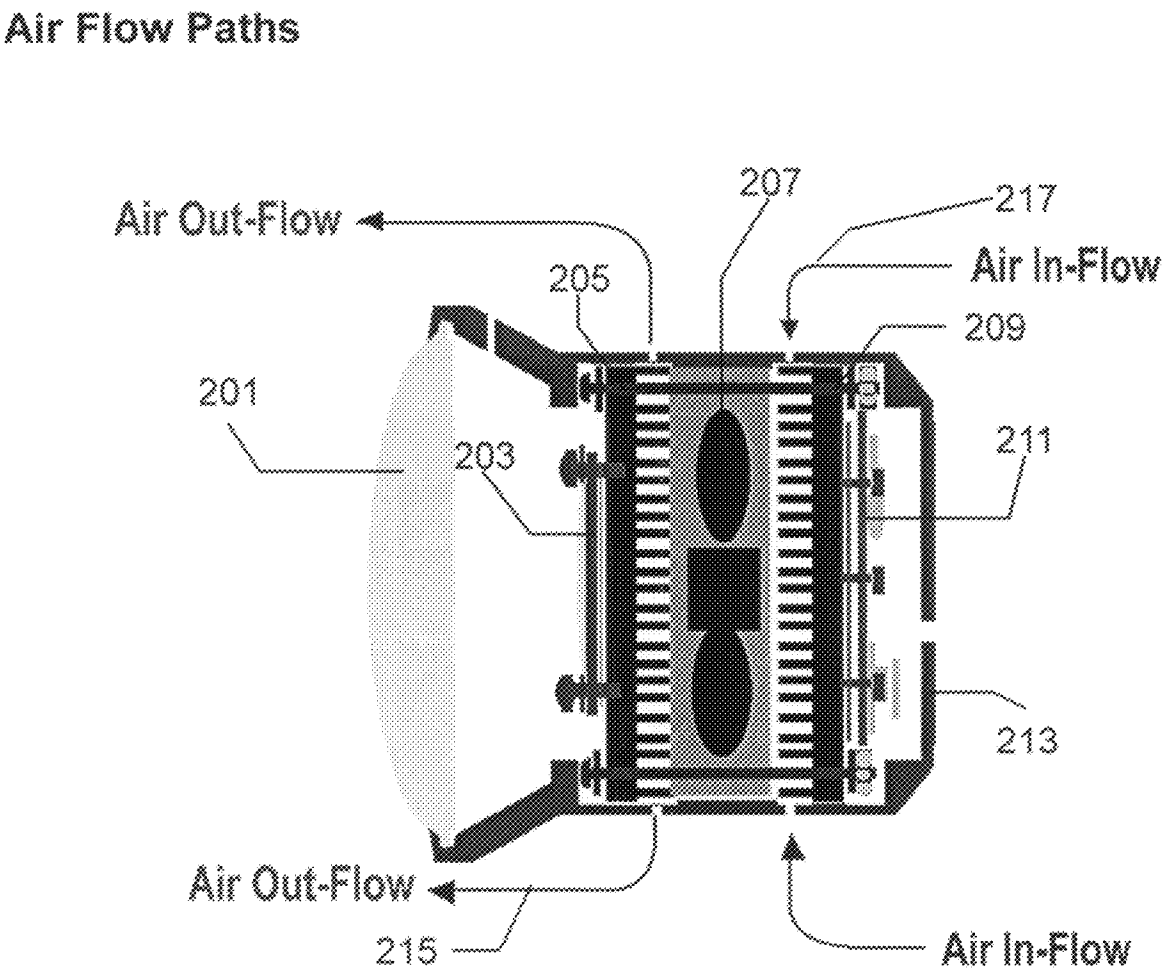
FIG. 2 shows cooling paths for a forced convection heat transfer embodiment of the invention.

FIG. 2 shows cooling paths for a forced convection heat transfer embodiment of the invention. Forced convection air 217 flows into the module through the housing 209 slots provided near the second cooling fin which is the sink for the driver electronics board 211 which is the second source of heat in the module. The air flow through travel in a path to cool two separate heat sources, the electronics board 211 and the LED array 203. The separation of the heat sources reduces the peak temperature of the module and is one method of mitigating the LED array 203 negative heat temperature effects and for increasing module efficiency. The fan 207 provides the suction from the second heat and forces the air into the first cooling fin element 205 which collects heat from the LED array 203 and pushes it out of the module 215 through slots in the housing 209. The cooled LED array is kept as cool as possible to emit light through the lens element 201. By dividing the heat sources and placing them sandwiched between separate cooling elements provides a compact LED module geometry effectively reducing peak LED array 203 temperatures while efficiently removing waste heat.

Figure 3:
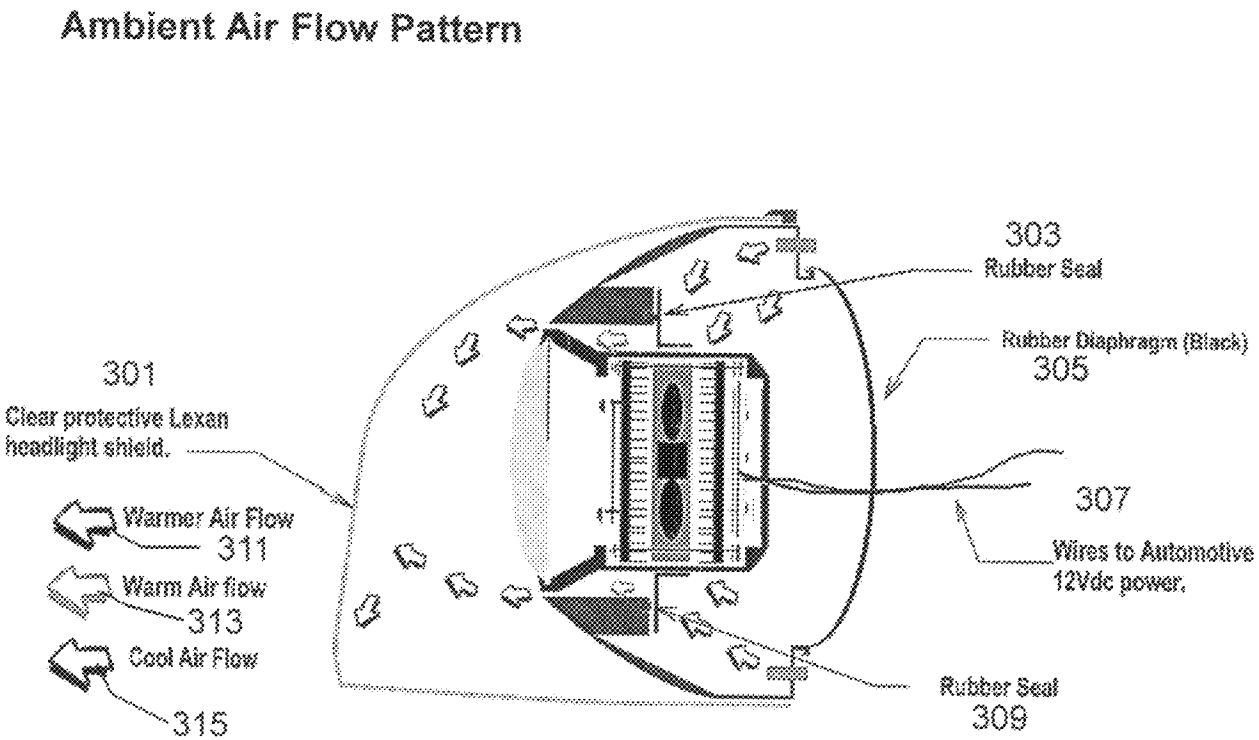
FIG. 3 illustration shows the headlamp assembly cooling for a forced convection heat transfer embodiment of the invention.

FIG. 3 illustration shows the headlamp assembly housing an LED module in a forced convection cooling heat transfer embodiment of the invention. Cooling air 315 is admitted through the lamp assembly housing between the rubber diaphragm 305 seal in the rear and the plastic or glass protective shield 301 in the front. As the air cycles through the LED module and cools the fins the air warms 313. As it exits the LED module and enters the assembly volume the air is warmest 311 but is cooled by contact with the protective shield which is exposed to ambient air. The lamp assembly clear protective plastic/glass headlight shield 301 allows the warmer air 311 to cool in the assembly chamber. A rubber diaphragm 305 generally seals the back of the assembly containing the LED module allowing power wires 307 through to the vehicle power source.

Figure 4:
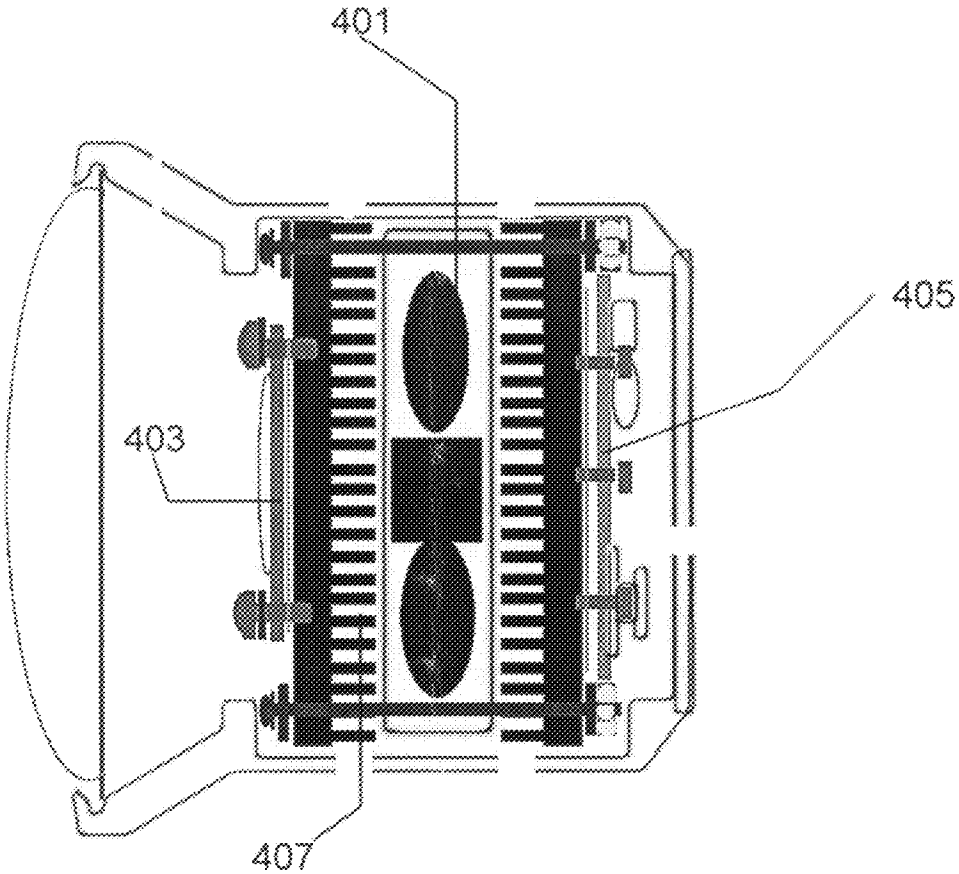
FIG. 4 is a schematic diagram showing placement of sensors for temperature metrics for an embodiment of the present invention.

FIG. 4 is a schematic diagram showing placement of sensors for temperature metrics for an embodiment of the present invention. Thermocouple measurements were made at steady state conditions for locations on the LED array 403, first cooling element 407 approximately at the center and opposite of the backside of the LED array and the electronic driver casing 405. With the fan 401 off and no forced convection cooling through the module, the LED array 403 reached a temperature of 115+ deg. C., the driver casing 405 reached a temperature of 70 deg. C. and the first cooling element 407 reached 115 deg. C. With the fan 401 on and at steady state, the LED array 403 reached 71 deg C., the cooling element reached 71 deg. C. and the driver casing 405 reached 49 deg. C. The drop in temperature at the LED array was 45 deg. C. for steady state conditions. This peak temperature at the LED array 403 adds reliability to the module because it exceeds the life expectancy of this type of lamp which run hotter, shortening their life expectancy.

Figure 5:
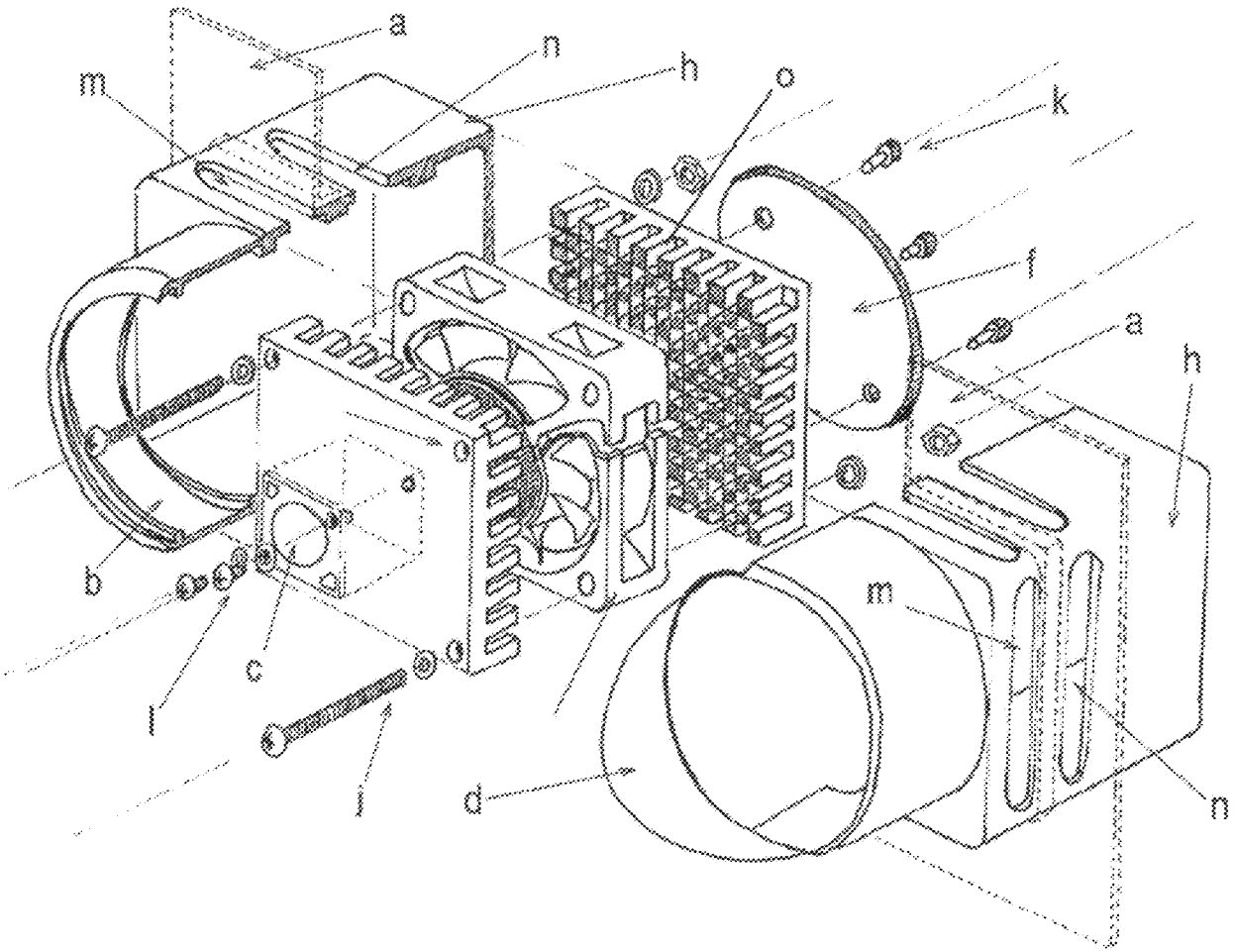
FIG. 5 is an isometric diagram an LED module elements in accordance with an embodiment of the present invention.

FIG. 5 is an isometric diagram of LED module and components in accordance with an embodiment of the present invention. The elements for this embodiment are labeled and described below.

a. Module Support Bracket—this bracket serves to hold and support modules' body in headlight assembly. This also means of separating air pulling from first compartment to second compartment.

b. Internal Reflector—this side is coated or inserted with mirror finish reflector (is also called Total Internal Reflector) for deflecting beam of light to the optic.

c. LED Array—is a LED array which has multi-LED die in the protective silicon. It composes of 25 die. Power consumption is 24.75 watts with a thermal Impedance of 1.81 deg.C/W.

d. Aspheric Lens—this lens is made from a borosilicate. Dimension is 63.5 mm×23.5 mm, 5~90-degree 97% transmittance optic.

e. Thermal compound applied under the LED Array.

f. LED Driver Printed Circuit Board. PCB is made from a regular FR4 materials or Metal Core PCB.

g. Mini-fan. Fan dimension is 50 mm×50 mm×10 mm. The type of fan used is NCB (Nanometer Ceramic Bearing). NCB has longer life span, lower noise, better durability, Anti-Shock/Anti-vibration, water proof, Resistant to oxidation and chemical.

h. Module Enclosure—is made from thermoplastic or an aluminum.

i. Drilled holes on heatsink is for wiring path from fan and power supply line for LED array.

j. Pan Head Philip® screws with washer and lock nut.

k. A 4-40 cylindrical head screws with lock washers—three pieces of 4-40 screws for PCB assembly and LED array. I. Same as on k, except a pan head philip or 1/16 alien head screw. m. Hot air outlet from PCB and LED array. m. Air intake to cool PCB and LED array.

l. Same as on k, except a pan head Philip® or 1/16 Allen® head screw.

m. Hot air outlet from PCB and LED array.

n. Air intake to cool PCB and LED array.

o. A planar heat sink with short legs, configured in row-column, circular or spiral pattern.

Figure 6:
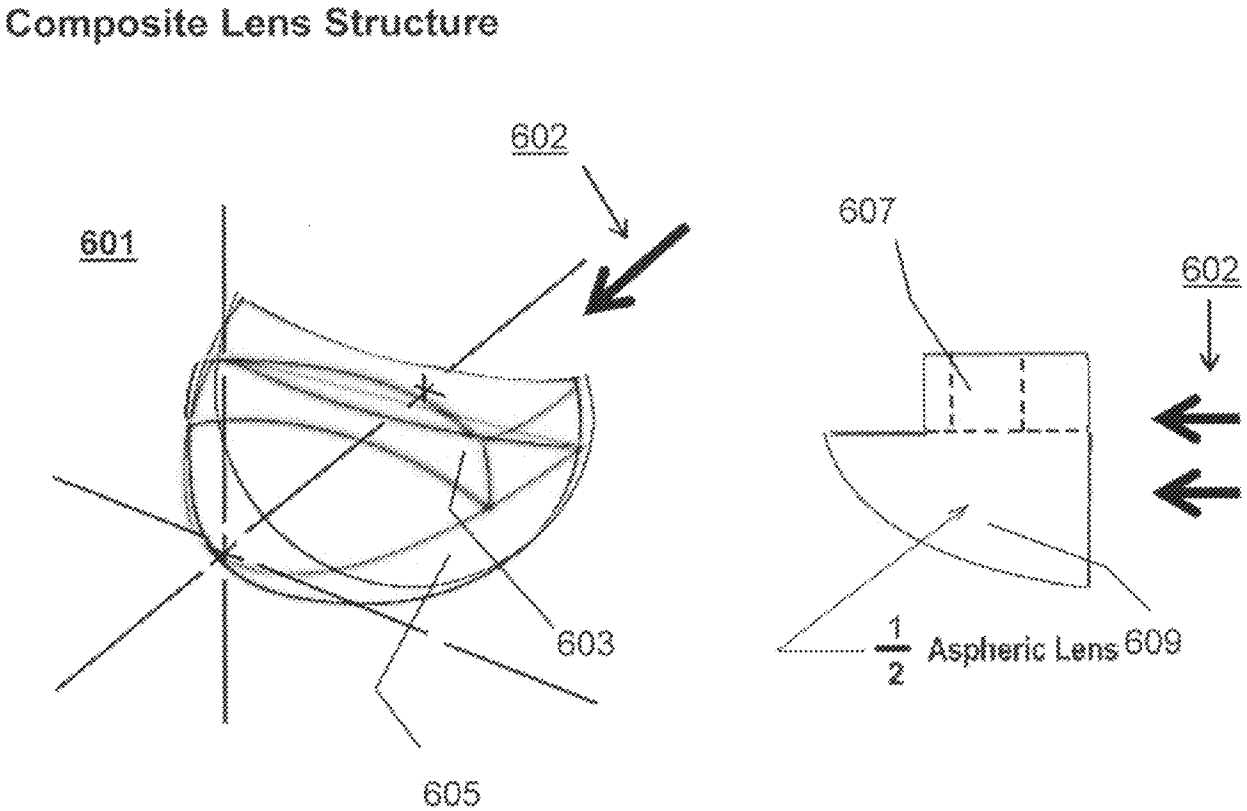
FIG. 6 is an isometric diagram and profile view of a composite lens element in accordance with an embodiment of the present invention.

FIG. 6 is an isometric diagram and profile view of a composite lens element in accordance with an embodiment of the present invention. An optical composite lens 601 is shown comprising a partially aspheric lens with a axial cross-sectional flat side uniformly coupled to a flat bi-curvature lens element, the curvature being concave for both sides. The composite lens is coupled so as minimize internal reflection and refraction from the common boundary. This it may be formed as one monolithic plastic or glass material with compatible optical properties and index of refractions to maximize light in the pattern desired. LED light comes from the direction 602 opposite the aspheric vertex and exits through the optical output surfaces 603 605.

An the embodiment shown, a flat top and bottom bi-concave lens element 607 is coupled to a flat uniform surface of a half aspheric element 609, for redirecting and collimating light emanating from the LED light source input surface side 602 and towards the lens output surface 603 605.

Figure 7:
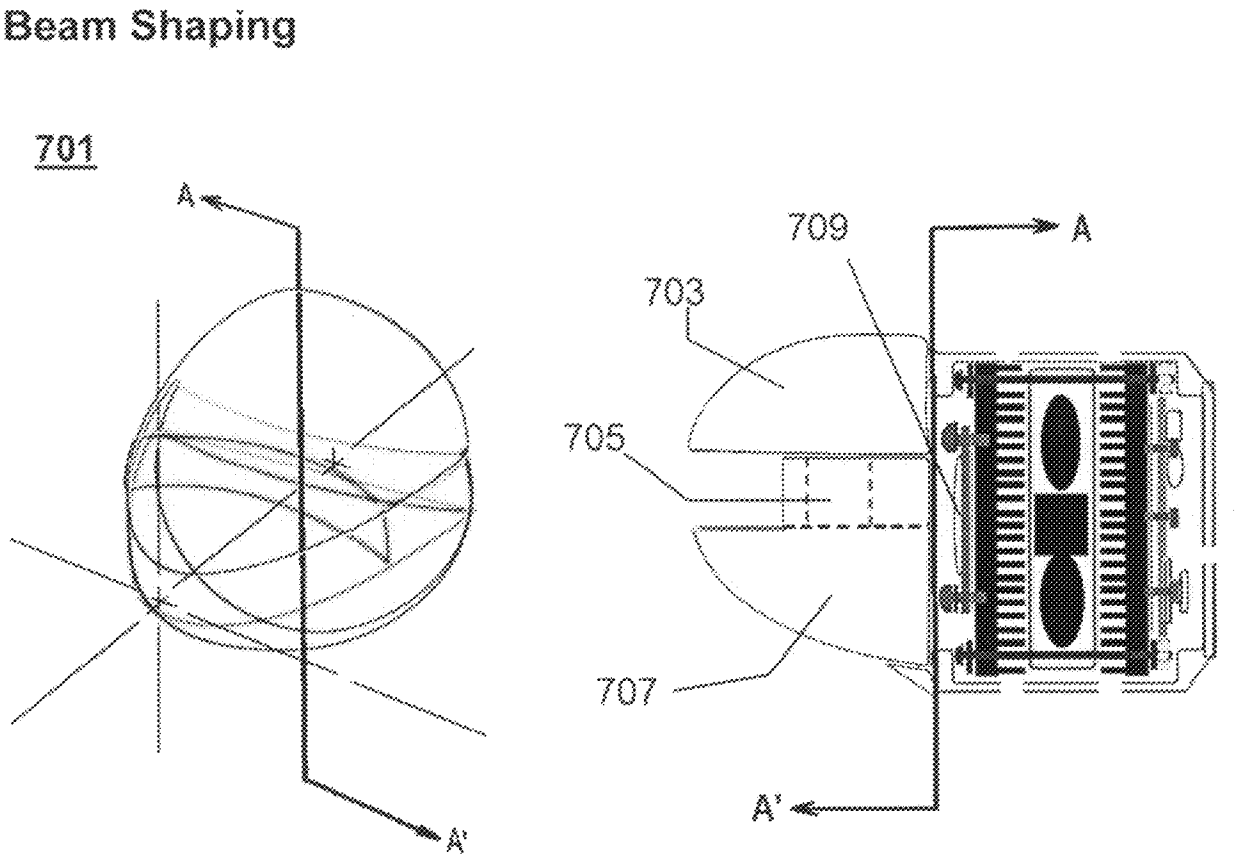
FIG. 7 is an isometric diagram and profile of a composite lens element with beam shaping component in accordance with an embodiment of the present invention.

FIG. 7 is an isometric diagram and profile of a composite lens element with beam shaping component in accordance with an embodiment of the present invention.

The LED source 709 emits light into the bi-concave lens element 705 and the semi-aspheric lens element 707. The light attempting to leave the bi-concave lens element 705 on the opposite side of the aspheric lens 707 will be reflected and back from the non-translucent thermo-plastic component 703 which has a reflecting surface uniformly snug or monolithic to the bi-concave lens 705 top side boundary. The optically translucent lens element 703 extends outward to reflect stray light back to the optical output direction.

Figure 8:
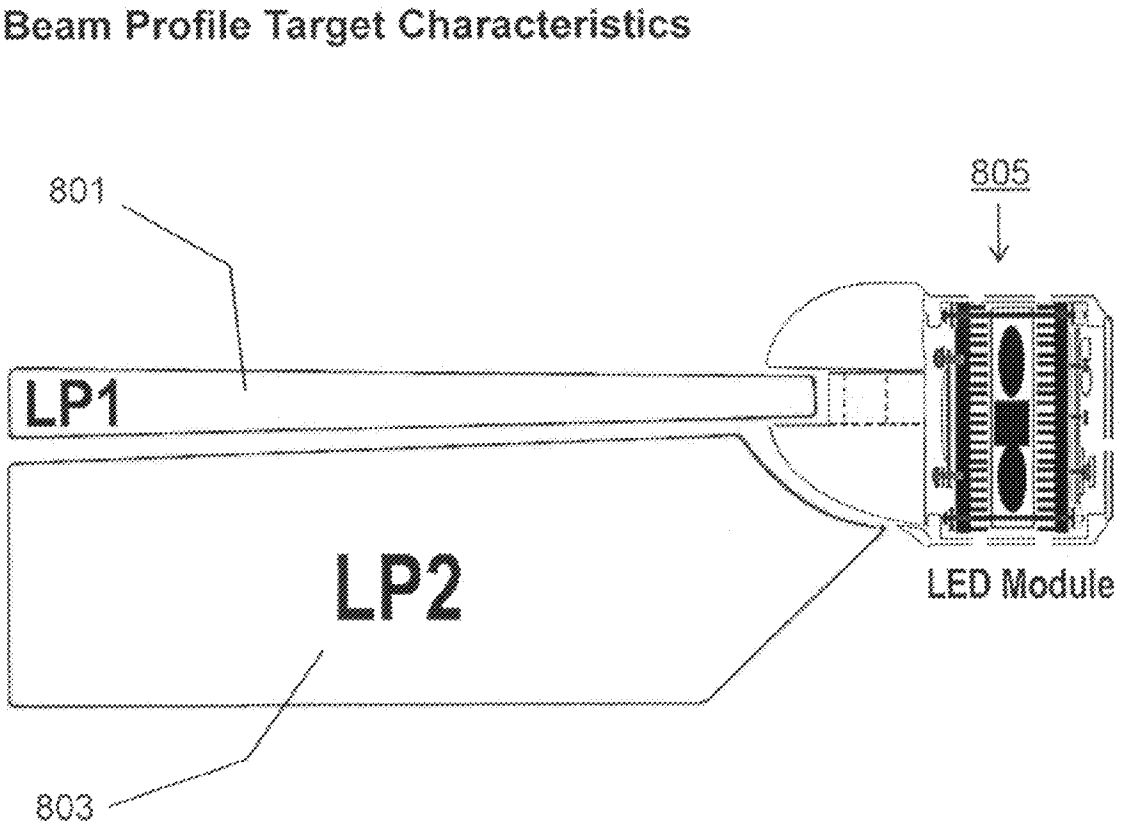
FIG. 8 is a schematic of beam profile character in accordance with an embodiment of the present invention.

FIG. 8 is a schematic of beam profile target character in accordance with an embodiment of the present invention. As shown the bi-concave lens element emits a beam forward 801 and the normal surface is adjusted as needed to intersect the beam with the road at the required distance in front of the lens. The aspherical lens component emits light profile 803 in a more vertical dispersive pattern. Together the lens components can be adjusted to fit most beam profiles without the addition of more lamps. Additional lamps can be used as well as additional layers of lens components to achieve desired beam profiles from an embodiment of the invention LED module 801.

Figure 9:
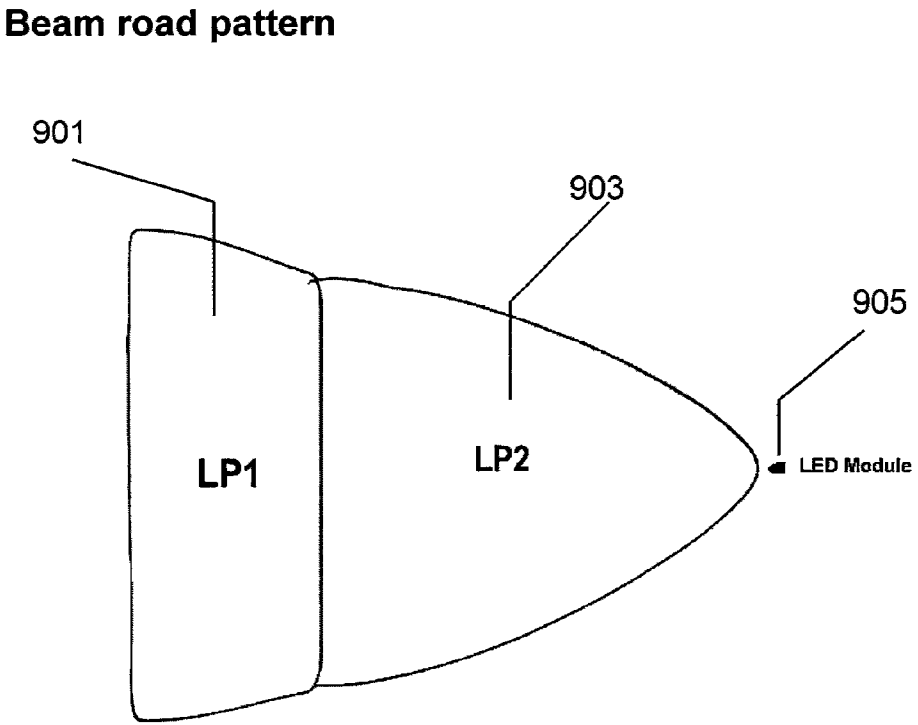
FIG. 9 is a schematic of beam road pattern in accordance with an embodiment of the present invention.

FIG. 9 is a diagram of a beam road pattern in accordance with an embodiment of the present invention. The conventional method of shading or blocking light to obtain an acceptable road illumination pattern is wasteful and the embodiments of the instant invention overcomes that waste by projecting all of the illumination forward and slightly downward to make full use of all light produced by the LED source. An LED source light 905 having a composite lens will project light from the bi-concave lens element onto the LP1 region 901 for distant illumination and the LP2 region 903 more proximate to the vehicle.

Altogether the LED light module contains a compactly structured LED light source with beam shaping composite lens for collimating and directing light onto a desired forward pattern, associated thermal management and control circuitry for minimizing the LED negative temperature coefficient character. This all in one package installable in a vehicle headlight with minimum space requirements and in compliance with multi-lobe road illumination requirements.

Figure 10:
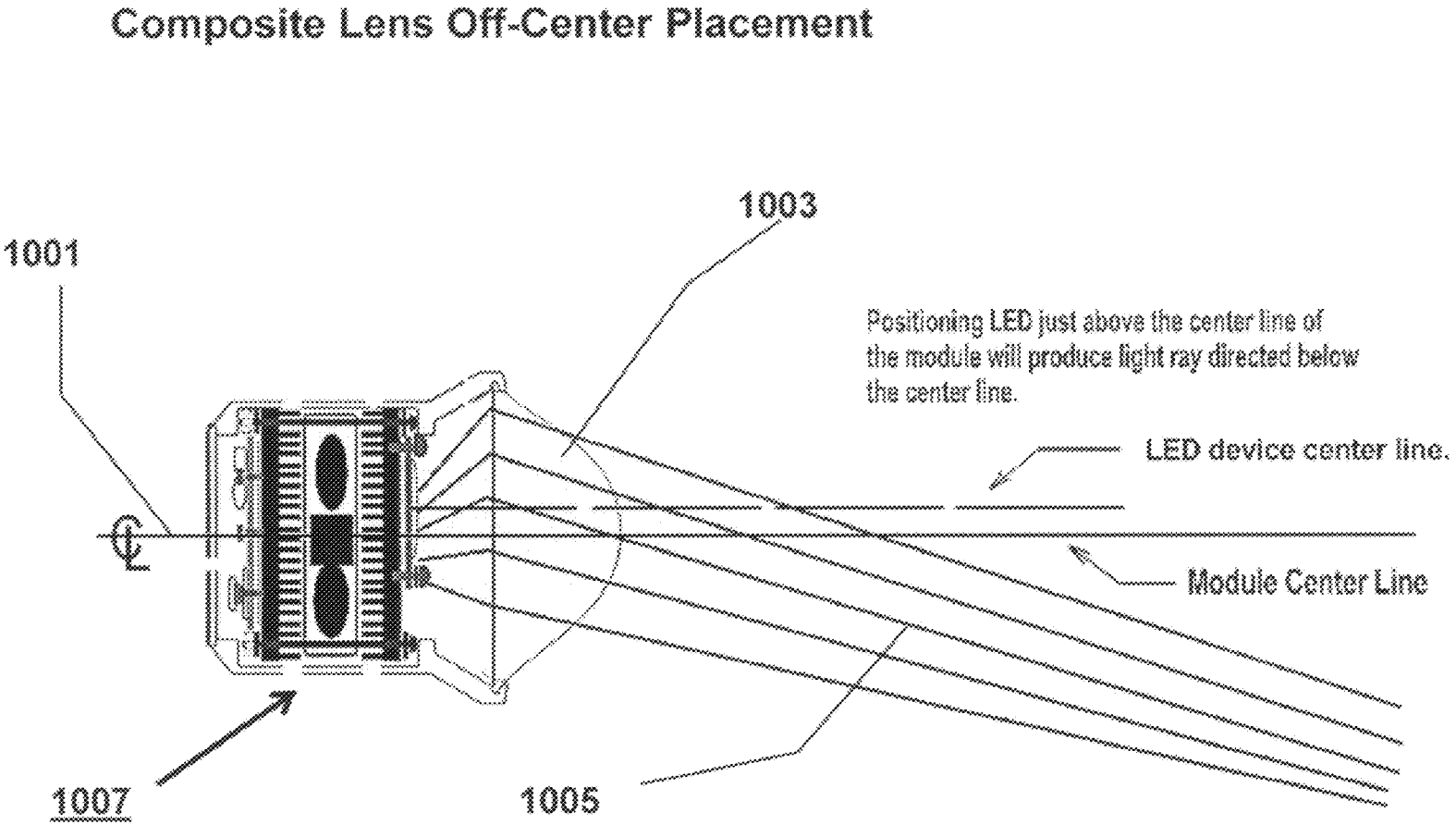
FIG. 10 illustrates beam direction via off lens centerline positioning for beam steering in an embodiment of the present invention.

FIG. 10 illustrates beam direction aimed by off-axis composite lens centerline 1001 positioning of module 1007 with lens 1003 for beam 1005 placement in the opposite off-centerline direction in an embodiment of the invention. The LED light module 1007 has positioned the composite lens 1003 off-center to direct the beam in the axially opposite direction. The angle of the beam 1005 deflection is responsive to the off-centerline 1001 placement distance relative to the axis centerline 1001. As an example, positioning the LED just above the centerline 1001 of the module 1007 will produce beam directed below the centerline 1001, so it is the relative positions of the LED and the lens which determines beam direction.

Figure 11:
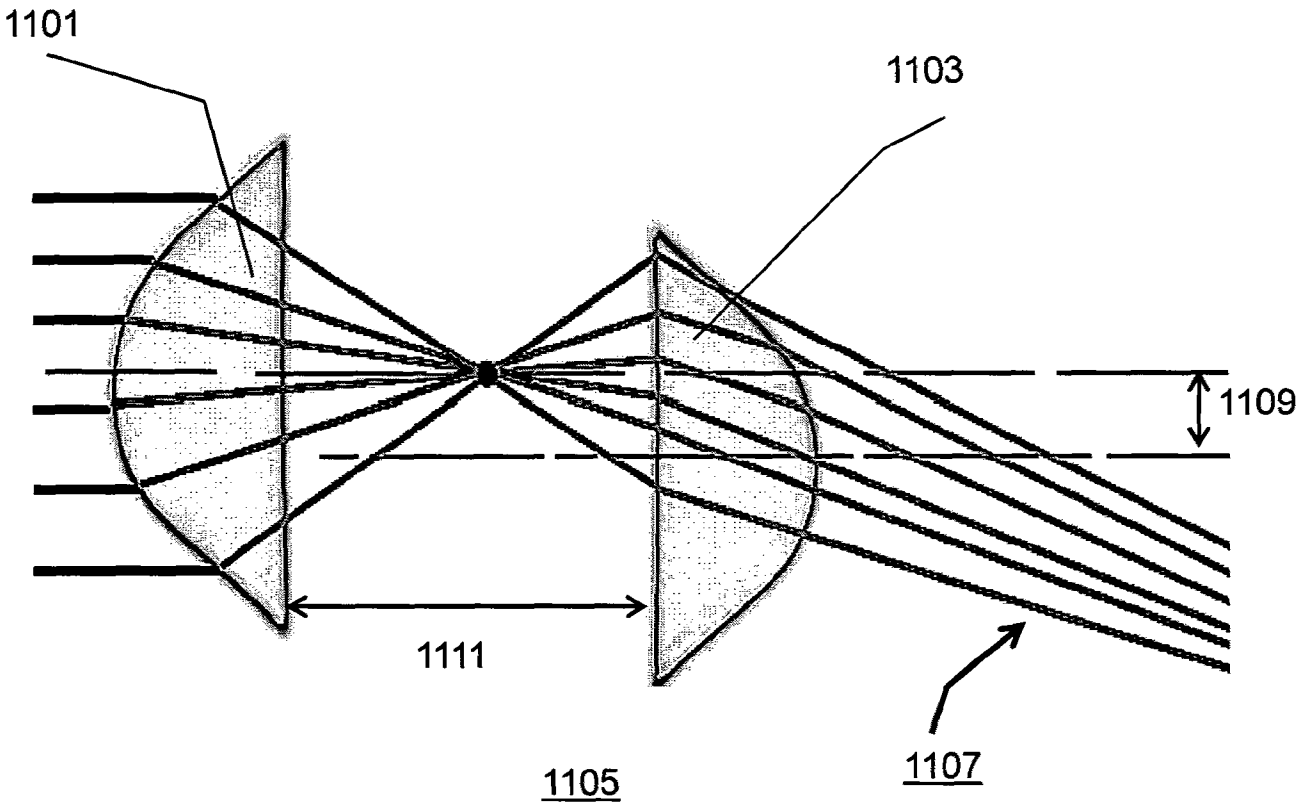
FIG. 11 is a illustration showing a back to back aspheric lens configuration in accordance with an embodiment of the present invention.

FIG. 11 is a illustration showing a back to back aspheric composite lens configuration in accordance with an embodiment of the present invention. The LED light module further comprising two aspheric lenses 1101 1103 optically configured back to back and with one at offset 1109 to the others axial centerline 1105 adjustable to bend the LED array light beam off centerline and at a desired angle, distance between 1111 the aspheric lenses 1101 1103 to determine the angle 1107 of beam bend off centerline.

Therefore, while the invention has been described with respect to a limited number of embodiments, those skilled in the art, having benefit of this invention, will appreciate that other embodiments can be devised which do not depart from the scope of the invention as disclosed herein. Other aspects of the invention will be apparent from the following description and the appended claims.

What is claimed is:

1. An LED light source module comprising:

an LED array light source on backing thermally coupled to a first cooling fin element;

the first cooling fin element thermally coupled to the LED with the opposite side having an array of perpendicularly protruding cooling fin short legs with distal ends adjacent to a fan, protruding cooling fin leg array supported by a substantially thin flat base element;

the thin flattened fan in a plane parallel to the first cooling fin base element, sandwiched between the first cooling fin element and a second cooling fin element, wherein the fan electrically coupled to a power source;

the second cooling fin element juxtaposed and parallel to the first cooling fin element, comprising a flat base supporting an array of protruding cooling fin short legs with distal ends adjacent to the fan and base ends coupled to the thin base element in a plane parallel to the plane of the fan, the base element side opposite the leg array thermally coupled to an LED driver circuit board;

the LED driver circuit board with electronic circuitry for supplying the LED light source with voltage and current of a predetermined waveform and magnitude to power the LED source in accordance with electrical requirements of the LED and electronics;

an optical composite lens comprising a at least one partial aspheric lens configured with respect to the LED array light source beam centerline;

whereby the LED light module contains a compactly structured LED light source with beam shaping composite lens for collimating and directing light onto a desired forward pattern, associated thermal management and control circuitry for minimizing the LED negative temperature coefficient character, all in one package.

2. The LED light module of claim 1, wherein the LED light source is physically separated from the electronic circuitry by the heat removal mechanism to decouple the heat flow paths thereby reducing the peak LED temperatures by virtue of physical separation of heat sources.

3. The LED light module of claim 1 wherein the lens material is chosen from a group of materials consisting essentially of glass, plastic, thermo-plastic and non-translucent thermo-plastic.

4. The LED light module of claim 3 wherein the lens material is borosilicate of high transmittance optical character.

5. The LED light module of claim 1 further comprising a circular array pattern of cooling legs positioned radially from the array center and co-axially aligned with the fan axis.

6. The LED light module of claim 1 further comprising an internal reflector with mirror finish along the periphery of the lens composite and symmetric about the lens radial axis for optically reflecting and refracting light back to the lens output surface.

7. The LED light module of claim 1 wherein the fan is a nanometer ceramic bearing type.

8. The LED light module of claim 1 wherein at least one heat sink module is of anodized aluminum material.

9. The LED light module of claim 1 further comprising a spiral array pattern of cooling legs positioned radially from the axial array center and co-axially aligned with the fan center.

10. The LED light module of claim 1 comprising a composite lens with bi-curvature lens element input and output optic surface curvature, constructed to position the beam on a directed forward beam deflection from centerline of the LED source.

11. The LED light module of claim 1 further comprising a composite lens with one aspheric lens and a cross-sectional flat side uniformly coupled to a flat bi-curvature lens element, the flat bi-directional lens element coupled to a reflective surface on the side opposite the aspheric element side, for redirecting and collimating light emanating from the LED light source input surface and towards the lens output surface.

12. The LED light module of claim 1 further comprising a composite lens with a bi-concave bi-curvature lens element and adjacent to a cross-sectional shortened aspheric composite lens element.

13. The LED light module of claim 12 further comprising an aspheric non-translucent thermo-plastic component adjacent to the bi-concave lens element opposite the optically translucent lens element and extending outward to reflect stray beam back to the optical output direction.

14. The LED light module of claim 1 further comprising two aspheric lenses optically configured back to back and centerline adjustable to bend the LED array light beam off centerline, distance between the aspheric lenses to determine the angle of beam bend off centerline.

15. The LED light module of claim 1 wherein the composite lens elements positioned off-center will direct the beam in the axially opposite direction to the offset, and the angle of the beam deflection is responsive to the off-centerline lens placement and distance between the lens elements.

* * * * *